US006412565B1

(12) United States Patent
Castaño-Mears

(10) Patent No.: US 6,412,565 B1
(45) Date of Patent: Jul. 2, 2002

(54) EXPANDABLE SCREEN JACKET AND METHODS OF USING SAME

(75) Inventor: Ana M. Castaño-Mears, Coppell, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/627,196

(22) Filed: Jul. 27, 2000

(51) Int. Cl.[7] ..... E21B 43/08
(52) U.S. Cl. ..... 166/381; 166/230
(58) Field of Search ..... 166/230, 233, 166/228, 231, 207, 381

(56) References Cited

U.S. PATENT DOCUMENTS

| | | | | |
|---|---|---|---|---|
| 261,253 A | * | 7/1882 | Olmsted | 166/230 |
| 746,378 A | * | 12/1903 | Redfield | 166/230 |
| 1,342,986 A | * | 6/1920 | Cater | 166/230 |
| 1,514,062 A | | 11/1924 | McLain | |
| 1,520,376 A | * | 12/1924 | Verneuil | 166/230 |
| 1,915,136 A | * | 6/1933 | Share | 166/230 |
| 2,877,852 A | * | 3/1959 | Bashara | 166/230 |
| 3,179,168 A | | 4/1965 | Vincent | 166/14 |
| 3,203,483 A | | 8/1965 | Vincent | 166/207 |
| 3,270,817 A | | 9/1966 | Papaila | 166/46 |
| 3,353,599 A | | 11/1967 | Swift | 166/15 |
| 3,477,506 A | | 11/1969 | Malone | 166/207 |
| 3,498,376 A | | 3/1970 | Sizer et al. | 166/120 |
| 3,669,190 A | | 6/1972 | Sizer et al. | 166/315 |
| 3,746,091 A | | 7/1973 | Owen et al. | 166/207 |
| 3,776,307 A | | 12/1973 | Young | 166/125 |
| 4,095,825 A | | 6/1978 | Butler | 285/55 |
| 4,687,232 A | | 8/1987 | Zimmerman | 285/31 |
| 5,014,779 A | | 5/1991 | Meling et al. | 166/55.7 |
| 5,642,781 A | * | 7/1997 | Richard | 166/231 |
| 5,667,011 A | | 9/1997 | Gill et al. | 166/295 |
| 5,901,789 A | * | 5/1999 | Donnelly et al. | 166/381 |
| 5,924,745 A | | 7/1999 | Campbell | 285/90 |
| 5,984,568 A | | 11/1999 | Lohbeck | 403/375 |
| 6,012,523 A | | 1/2000 | Campbell et al. | 166/277 |
| 6,021,850 A | | 2/2000 | Wood et al. | 166/380 |
| 6,029,748 A | | 2/2000 | Forsyth et al. | 166/380 |
| 6,070,671 A | | 6/2000 | Cumming et al. | 166/381 |

FOREIGN PATENT DOCUMENTS

| | | |
|---|---|---|
| GB | 2 344 606 A | 6/2000 |
| WO | WO 96/37680 | 11/1996 |
| WO | WO 97/17527 | 5/1997 |
| WO | WO 98/49423 | 11/1998 |
| WO | WO 99/56000 | 11/1999 |
| WO | WO 00/26500 | 5/2000 |
| WO | WO 00/26501 | 5/2000 |
| WO | WO 00/26502 | 5/2000 |

* cited by examiner

*Primary Examiner*—Frank Tsay
(74) *Attorney, Agent, or Firm*—William M. Imwalle; Todd E. Albanesi

(57) ABSTRACT

Disclosed are apparatus and methods for sand-control in a subterranean well. A radially expandable sand-control screen jacket apparatus and related methods are disclosed. The apparatus has a screen jacket assembly surrounding a base pipe and having at least one inner screen element contacting the base pipe and at least one outer screen element overlapping the adjacent inner screen element. The joints between the inner and outer screen elements comprise sand-controlling joints.

30 Claims, 3 Drawing Sheets

EXPANDABLE SCREEN JACKET AND METHODS OF USING SAME

TECHNICAL FIELD

The present inventions relate to sand-control apparatus for use in subterranean wells, and in particular contemplate improved configurations for radially expandable sand-control screen jacket apparatus and methods of using the same.

BACKGROUND OF THE INVENTION

The control of the movement of sand and gravel into a well bore has been the subject of much importance in the oil production industry. The introduction of sand or gravel into the well bore commonly occurs under certain well conditions. The introduction of these materials into the well commonly causes problems including plugged formations or well tubing, and erosion of tubing and equipment. There have therefore been numerous attempts to prevent the introduction of sand and gravel into the production stream.

A common method to prevent the introduction of sand and gravel into the production stream has been a procedure known as gravel packing. In general, this involves placing selected sand or gravel into the annular space between the well bore and a base pipe introduced into the wellbore for that purpose. The base pipe contains perforations designed to allow well fluids to flow into the base pipe while excluding other material. A sand-control screen is commonly used in conjunction with a base pipe. An appropriately sized screen is commonly formed into a jacket and placed concentrically around the outside of the base pipe to prevent the entry of sand into the base pipe. Exemplary apparatus and methods of attaching a sand-control screen jacket to a base pipe are disclosed in U.S. Pat. No. 5,931,232, and in application Ser. No. 09/602,387, which are both assigned to this assignee and is incorporated herein for all purposes by this reference thereto.

One method of enhancing production in a well using a sand-control screen jacket includes causing the radial expansion of the base pipe and surrounding screen jacket by forcing a mechanical expansion tool through the base pipe. Examples of deformable well screens are disclosed in U.S. Pat. Nos. 5,901,789 and 6,012,522, to Donnelly. These methods use screens and methods to control the screen mesh opening size.

It is important that an expandable sand-control screen maintain its integrity throughout its entire length. Any voids in the screen that permit the entry of sand generally lead to erosion, which in turn allows the entry of more sand into the production stream. Wellbores with irregular sides or a particularly tortuous path, in order to allow sufficient clearance for insertion, generally require sand-control screen jackets having a diameter much smaller than the diameter of the wellbore. The radial expansion of a small diameter sand-control screen jacket into a much larger diameter wellbore can be particularly problematic. Extreme levels of expansion can lead to loss of integrity of the screen jacket connections with the base pipe. The result is the introduction of sand into the production stream and all of the attendant problems associated therewith.

Due to the aforementioned problems with the introduction of sand and gravel into the production stream, a need exists for apparatus and methods ensuring a radially expandable sand-control screen capable of withstanding a high degree of expansion while retaining sand-controlling connections with the base pipe.

SUMMARY OF THE INVENTION

The invention provides apparatus and related methods for constructing and using a radially expandable sand-control screen jacket assembly for use in a subterranean well. The screen-jacket assembly has at least two overlapping screen elements surrounding a base pipe, with a longitudinal sand-control seal between screen elements. The assembly maintains sand control after being radially expanded.

According to different aspects of the invention, the screen jacket assembly has two, three, four, or more overlapping screen elements.

According to another aspect of the invention, the assembly is encased in a screen shroud.

According to still another aspect of the invention, the inner screen element edges and outer screen element edges are substantially helical with respect to the to axis of the base pipe.

According to another aspect of the invention, the outer screen element is biased toward the inner screen element.

BRIEF DESCRIPTION OF THE DRAWINGS

The accompanying drawings are incorporated into and form a part of the specification to illustrate several examples of the present inventions. These drawings together with the description serve to explain the principals of the inventions. The drawings are only for the purpose of illustrating preferred and alternative examples of how the inventions can be made and used and are not to be construed as limiting the inventions to only the illustrated and described examples. The various advantages and features of the present inventions will be apparent from a consideration of the drawings in which.

DETAILED DESCRIPTION

Figure 1:
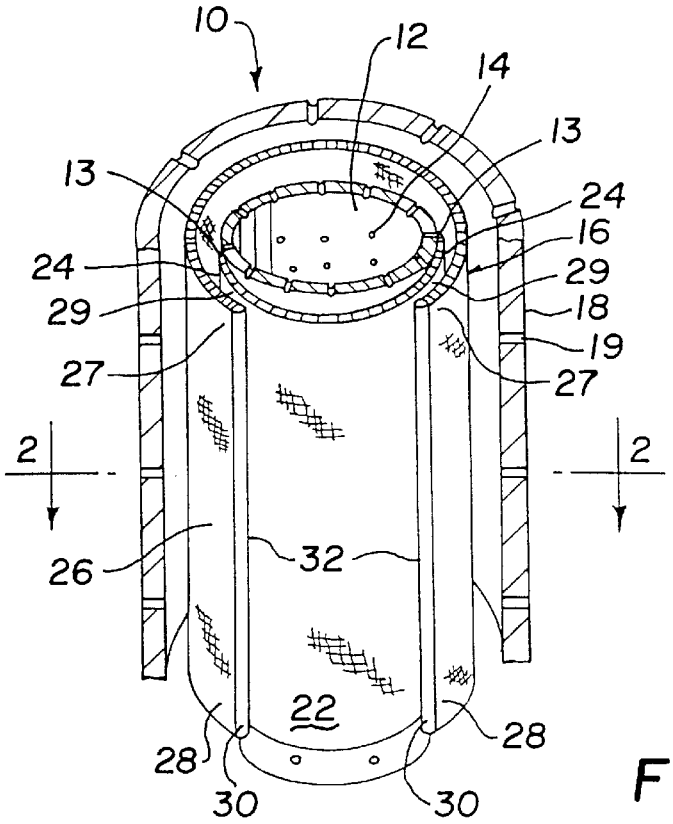
FIG. 1 is a top perspective view of a radially expandable sand-control screen jacket.

The present inventions are described by reference to drawings showing one or more examples of how the inventions can be made and used. In these drawings, reference characters are used throughout the several views to indicate like or corresponding parts.

In the description which follows, like or corresponding parts are marked throughout the specification and drawings with the same reference numerals, respectively. The drawings are not necessarily to scale and the proportions of certain parts have been exaggerated to better illustrate details and features of the invention. In the following description, the terms "upper," "upward," "lower," "below," "downhole", "longitudinally" and the like, as used herein, shall mean in relation to the bottom, or furthest extent of, the surrounding wellbore even though the wellbore or portions of it may be deviated or horizontal. Correspondingly, the "transverse" orientation shall mean the orientation perpendicular to the longitudinal orientation. "Longitudinally moveable", in particular, means movement with a longitudinal component, although a transverse component may be present as well. In the discussion which follows generally cylindrical well, pipe and tube components are assumed unless expressed otherwise. The term "sand-control" used herein means the exclusion of particles larger in cross section than a chosen size, whether sand, gravel, mineral, soil, organic matter, or a combination thereof.

Referring now to FIGS. 1–5, the general structure of a radially expandable sand-control apparatus 10 utilizing the present inventive concepts is shown. A base pipe 12 is connected to a pipe string (not shown) used in a subterranean well. The base pipe 12 has a plurality of perforations 14 through which fluids in the well enters the interior of the base pipe 12. The number and configuration of the perforations 14 is not critical to the invention so long as a balance between fluid production and pipe integrity is maintained. The sand-control screen jacket assembly 16 concentrically surrounds the base pipe 12. A screen shroud 18 with perforations 19 may surround the screen jacket assembly 16. It is important to note that the exact ordering and number of components of the screen jacket assembly are not crucial to the invention except as to the features further discussed below. For example, or multiple screens with or without intervening layers of packing medium may be included. The screen shroud 18 may also be omitted or replaced by an additional screen.

Figure 2:
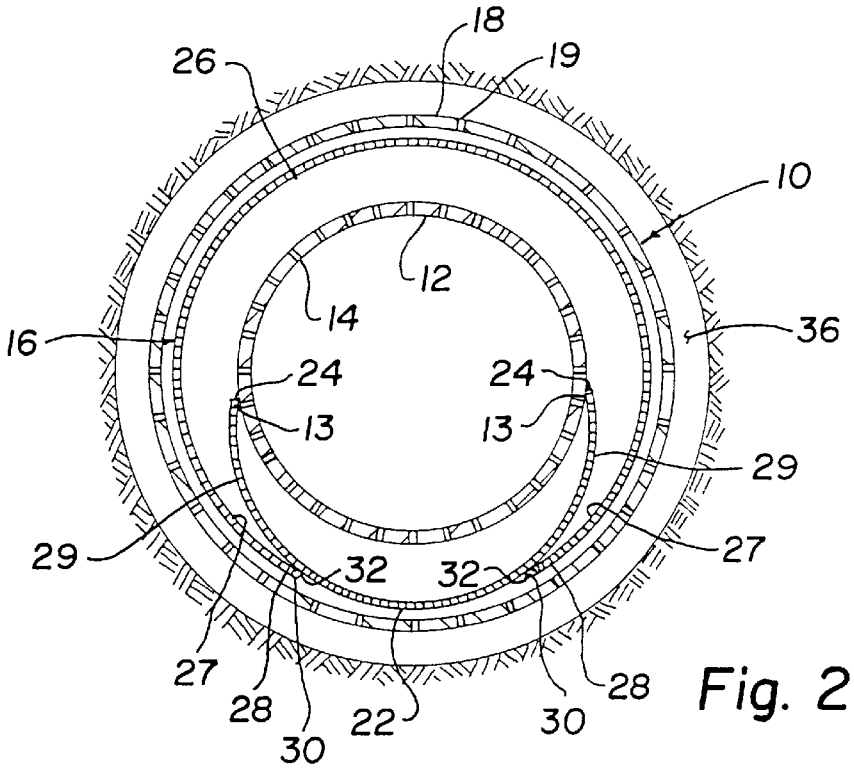
FIG. 2 is a transverse cross-sectional view of the radially expandable sand-control screen jacket taken along line 2—2 of FIG. 1.

Now referring primarily to FIG. 2, expandable sand-control apparatus 10 is shown in this cross-section view taken along line 2–2 of FIG. 1. The screen jacket assembly 16 has an inner screen element 22 attached at its longitudinal edges 24 to the base pipe 12. A base pipe joint 13 is formed at the point of attachment. The joint is preferably spot welded, or may be screwed, pinned, or on slidable channels, and is not necessarily sand-controlling. The inner screen element 22 and outer screen element 26 are preferably made of a screen, but may be made of other relatively low friction material such as "TEFLON"®, a registered trademark, or perforated sheet metal such as nickel or nickel alloy.

An outer screen element 26, substantially encircles the inner screen element 22. Longitudinal end portions 27 of outer screen element 26 at least partially overlap longitudinal end portions 29 of the inner screen element 22. The outer screen element may optionally completely encircle the inner screen element. The outer screen element 26 is preferably manufactured with a bias toward closing its edges 28 in the direction of the inner screen 22. The outer screen element edges 28 each have a seal element 30. The seal element 30 is preferably made from an elastomeric material but may be made from wire or a hollow wire designed to collapse in operation and seal upon radial expansion of the sand-control apparatus 10 as further discussed below. The contact between the seal elements 30 and the inner screen element 22 forms sand-control joints 32 sufficiently close-fitting after expansion to exclude sand particles of a size to also be excluded by the screen elements 22, 26, but not necessarily fluid tight. The joints 32 may or may not be sand-controlling prior to expansion. As the base pipe 12 and screen jacket assembly 16 are radially expanded, the overlapping portions 27, 29 of the joints 32 slide transversely with respect to one another while maintaining sand-controlling fits.

Figure 3:
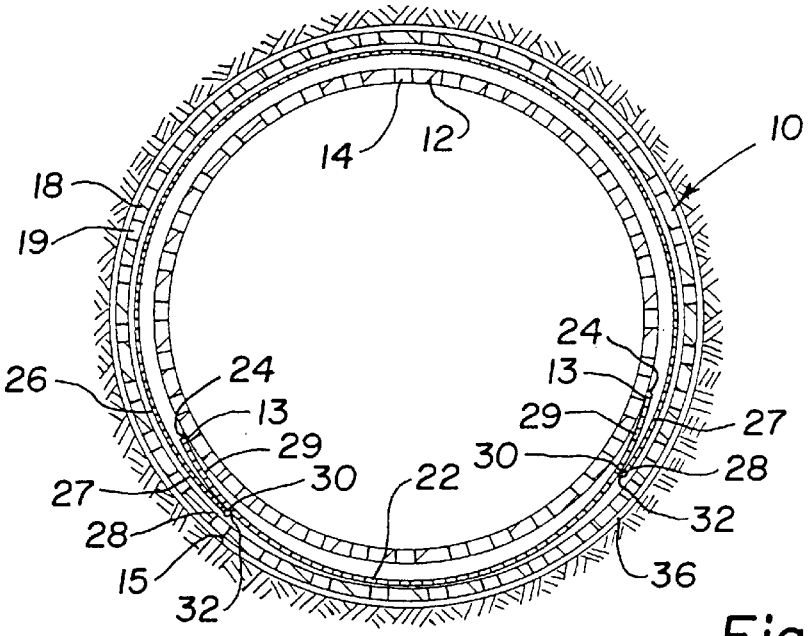
FIG. 3 is a transverse cross-sectional view of the radially expandable sand-control screen jacket of FIG. 2 in an expanded state.

Now referring primarily to FIG. 3, in operation, the sand-control apparatus 10 is expanded in the conventional manner, typically with an expansion cone (not shown). The base pipe 12 expands, as do the inner screen element 22, and the outer screen element 26, and screen shroud 18, if included. The components come to rest in the position drawn with seal element 30 in contact with inner screen element 22. If a hollow wire seal element 30 is used, the hollow wire collapses or partially collapses and maintains a sand-controlling seal. As the base pipe 12 and screen jacket assembly 16 are radially expanded, the overlapping portions 27, 29 of the sand-controlling joints 32 slide transversely with respect to one another, maintaining their sand-controlling fits. It is not critical to the invention for the base joints 13 to maintain their attachment to the expanded base pipe 12. The expanded sand-control apparatus 10 may be used with or without packing medium (not shown) in the annular space 36 between the expanded screen jacket assembly and the wellbore wall 15.

Figure 4:
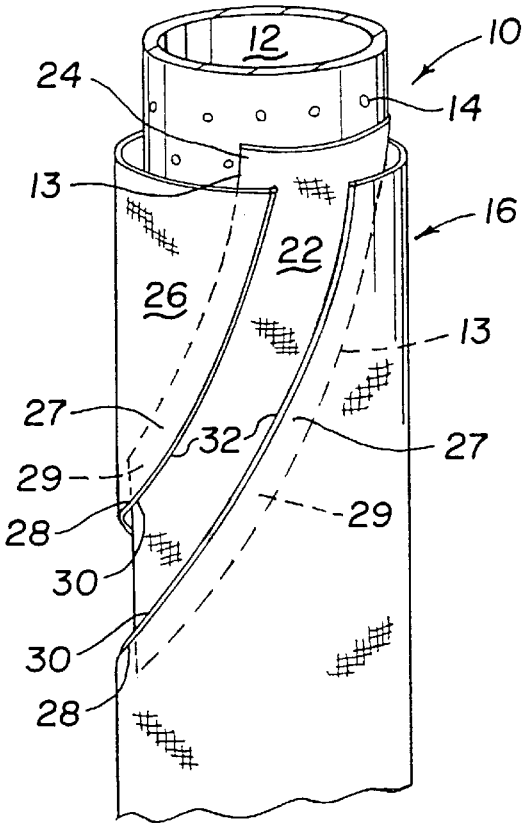
FIG. 4 is a top perspective view of an alternative embodiment of a radially expandable sand-control screen jacket in an unexpanded state.

Referring to FIG. 4, an alternative embodiment of the invention is shown wherein the inner and outer screen elements 22 and 26 are in helical form. In this embodiment, sand-control screen jacket assembly 16 surrounds base pipe 12. The sand-control screen jacket assembly may include a screen shroud (not shown). Inner screen element 22 is in helical form and is affixed along longitudinal edges 24 to the base pipe 12 forming base pipe joints 13. Outer screen element 26 substantially encircles the inner screen element 22 and is preferably spring-biased toward the inner element 22. Outer screen edges 28 each have a seal element 30. Longitudinal end portions 27 of the outer screen element 26 at least partially overlap the longitudinal end portions 29 of the inner screen element 22. The contact between the seal elements 30 and the inner screen element 22 forms sand-control joints 32 sufficiently close-fitting after expansion to exclude sand particles of a size to also be excluded by the screen elements 22, 26, but not necessarily fluid tight. The joints 32 may or may not be sand-controlling prior to expansion. As the base pipe 12 and screen jacket assembly 16 are radially expanded, the overlapping portions 27, 29 of the joints 32 slide transversely with respect to one another, maintaining their sand-controlling fits.

Figure 5:
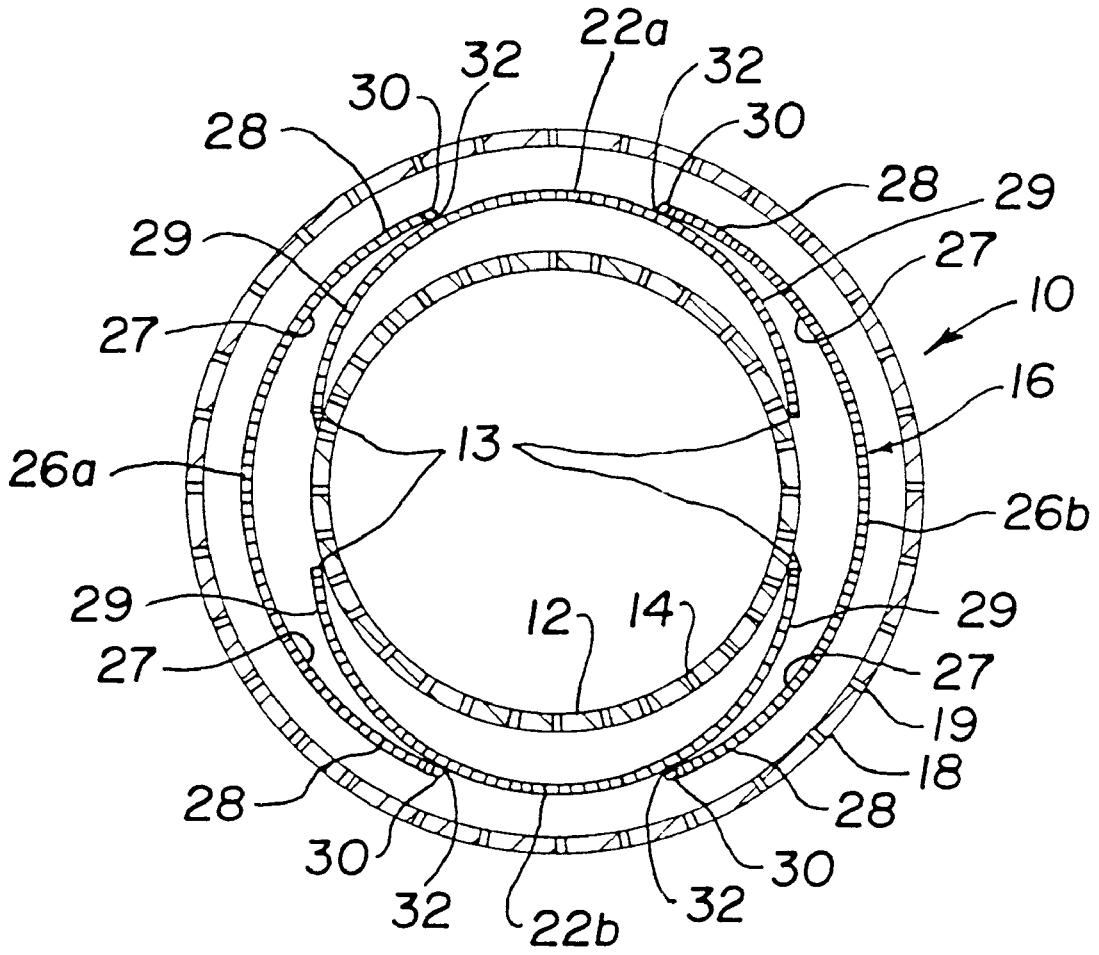
FIG. 5 is a transverse cross-sectional view of an alternative embodiment of the inventions.

Referring primarily to FIG. 5, an alternative example of the invention is shown wherein the invention is embodied with two inner screens 22*a*, 22*b*, and two outer screens 26*a*, 26*b*. Seal elements 30 are included where the longitudinal edges 28 of the outer screens 26 contact the inner screens 22. Also in this embodiment, the inner and outer screen elements 22, 26, may be helical in form. The seal elements 30 are preferably made from an elastomeric material but may be made from a wire or hollow wire designed to collapse and seal upon radial expansion of the sand-control apparatus 10. The contact between the seal elements 30 and the inner screen element 22 forms a sand-control joint 32 sufficiently close-fitting after expansion to exclude sand particles of a size to also be excluded by the screen elements 22*a,b*, 26*a,b*, but not necessarily fluid tight. The joints 32 may or may not be sand-controlling prior to expansion. As the base pipe 12 and screen jacket assembly 16 are radially expanded, the overlapping portions 27, 29 of the joints 32 slide transversely with respect to one another, maintaining their sand-controlling fits. The outer screen elements 26*a*, 26*b* are preferably manufactured with a spring-bias toward closing their longitudinal edges 28 in the direction of inner screens 22*a* and 22*b*. The screen elements may be made from materials known in the art for downhole screens.

The embodiments shown and described above are only exemplary. Many details are often found in the art such as: seal element or screen size, configurations and materials. Therefore, many such details are neither shown nor described. It is not claimed that all of the details, parts, elements, or steps described and shown were invented herein. Even though numerous characteristics and advantages of the present inventions have been set forth in the foregoing description, together with details of the structure and function of the inventions, the disclosure is illustrative only, and changes may be made in the detail, especially in matters of shape, size and arrangement of the parts within the principles of the inventions to the full extent indicated by the broad general meaning of the terms used in the attached claims.

The restrictive description and drawings of the specific examples above do not point out what an infringement of this patent would be, but are to provide at least one explanation of how to make and use the inventions. The limits of the inventions and the bounds of the patent protection are measured by and defined in the following claims.

What is claimed is:

1. A radially expandable sand-control screen jacket apparatus for use in a subterranean well comprising:

a base pipe;

a screen jacket assembly surrounding the base pipe;

the screen jacket assembly having an inner screen element contacting the base pipe along longitudinal base pipe joints; and an outer screen element at least partially overlapping the inner screen element, the outer screen element positioned for contacting the inner screen element along longitudinal sand-control joints upon expansion of the expandable screen jacket apparatus.

2. A radially expandable sand-control screen jacket apparatus for use in a subterranean well according to claim 1 wherein the outer screen element has two longitudinal end portions at least partially overlapping the inner screen element along two longitudinal inner screen element end portions.

3. A radially expandable sand-control screen jacket apparatus for use in a subterranean well according to claim 1 wherein the base pipe joints comprise slidable channels.

4. A radially expandable sand-control screen jacket apparatus for use in a subterranean well according to claim 1 wherein the base pipe joints are sand-controlling.

5. A radially expandable sand-control screen jacket apparatus for use in a subterranean well according to claim 1 wherein the outer screen element contacts the inner screen element.

6. A radially expandable sand-control screen jacket apparatus for use in a subterranean well according to claim 1, further comprising:

a screen shroud.

7. A radially expandable sand-control screen jacket apparatus for use in a subterranean well according to claim 1 wherein the base pipe joints are welded.

8. A radially expandable sand-control screen jacket apparatus for use in a subterranean well according to claim 2 wherein the inner screen element end portions and outer screen element end portions are substantially helical with respect to a longitudinal axis of the base pipe.

9. A radially expandable sand-control screenjacket apparatus for use in a subterranean well according to claim 2 wherein the outer screen element end portions are spring-biased toward the inner screen element.

10. A radially expandable sand-control screen jacket apparatus for use in a subterranean well according to claim 1 wherein at least one longitudinal sand-control joint comprises an elastomeric seal element.

11. A radially expandable sand-control screen jacket apparatus for use in a subterranean well according to claim 1 wherein at least one longitudinal sand-control joint comprises a wire seal element.

12. A radially expandable sand-control screen jacket apparatus for use in a subterranean well according to claim 11 wherein the wire seal element is crushable.

13. A radially expandable sand-control apparatus for use in a subterranean well comprising:

a base pipe;

a screen jacket assembly surrounding the base pipe;

the screen jacket assembly having alternating inner screen elements and outer screen elements;

each of the inner screen elements contacting the base pipe along longitudinal base pipe joints;

each of the outer screen elements at least partially overlapping the adjacent inner screen elements and positioned to form longitudinal sand-control joints between the outer and inner screen elements upon expansion of the sand-control apparatus.

14. A radially expandable sand-control screen jacket apparatus for use in a subterranean well according to claim 13 wherein the base pipe joints comprise slidable channels.

15. A radially expandable sand-control screen jacket apparatus for use in a subterranean well according to claim 13 wherein the base pipe joints are sand-controlling.

16. A radially expandable sand-control screen jacket apparatus for use in a subterranean well according to claim 13, further comprising:

a screen shroud.

17. A radially expandable sand-control screen jacket apparatus for use in a subterranean well according to claim 13 wherein the base pipe joints are welded.

18. A radially expandable sand-control screen jacket apparatus for use in a subterranean well according to claim 13 wherein the inner screen element and outer screen element edges are substantially helical with respect to the to axis of the base pipe.

19. A radially expandable sand-control screen jacket apparatus for use in a subterranean well according to claim 13 wherein the outer screen element edges are spring-biased toward the inner screen element.

20. A radially expandable sand-control screen jacket assembly for use in a subterranean well according to claim 13 wherein at least one longitudinal sand-control joint comprises an elastomeric seal element.

21. A radially expandable sand-control screen jacket apparatus for use in a subterranean well according to claim 13 wherein at least one longitudinal sand-control joint comprises a wire seal element.

22. A radially expandable sand-control screen jacket apparatus for use in a subterranean well according to claim 21 wherein the wire seal element is crushable.

23. A radially expandable sand-control screen jacket apparatus for use in a subterranean well according to claim 13 wherein the sand-control screen jacket apparatus comprises two or more inner screen elements and two or more outer screen elements.

24. A radially expandable sand-control screen jacket apparatus for use in a subterranean well according to claim 13 wherein the outer screen element contacts the inner screen element.

25. A method of sand-control in a subterranean well comprising the steps of:

placing a radially expandable screen jacket apparatus into the wellbore wherein an inner screen element contacts a base pipe along longitudinal base pipe joints and an outer screen element at least partially overlaps the inner screen element, the outer screen element having edges positioned to be in sand-controlling contact with the inner screen element upon expansion of the expandable screen jacket apparatus; and radially expanding the screen jacket apparatus.

26. A method according to claim 25 wherein the outer screen element has two longitudinal end portions at least partially overlapping the inner screen element.

27. A method according to claim 25 wherein the base pipe joints comprise slidable channels.

28. A method according to claim 25 wherein the outer screen element contacts the inner screen element prior to the step of radially expanding the screen jacket apparatus.

29. A method according to claim 25 wherein the screen jacket apparatus further comprises a screen shroud.

30. A method according to claim 26 wherein the inner screen element end portions and outer screen element end portions are substantially helical with respect to a longitudinal axis of the base pipe.

* * * * *